US006726613B1

(12) United States Patent
Sewell

(10) Patent No.: US 6,726,613 B1
(45) Date of Patent: Apr. 27, 2004

(54) METHOD AND APPARATUS FOR SETTING UP A CARTON

(75) Inventor: Peter Clive Sewell, Vancouver (CA)

(73) Assignee: Dekka Industries Inc.

( * ) Notice: Subject to any disclaimer, the term of this patent is extended or adjusted under 35 U.S.C. 154(b) by 0 days.

(21) Appl. No.: 10/291,423

(22) Filed: Nov. 12, 2002

(51) Int. Cl.[7] ..... B31B 1/78

(52) U.S. Cl. ..... 493/309; 493/180; 493/80; 493/124

(58) Field of Search ..... 493/180, 183, 493/80, 81, 124, 309

(56) References Cited

U.S. PATENT DOCUMENTS 3,477,349 A * 11/1969 Berney ..... 493/30
3,605,377 A * 9/1971 Sabel ..... 53/495
4,170,929 A * 10/1979 McDowell ..... 493/313
4,213,285 A * 7/1980 Mancini ..... 53/136.4
4,578,054 A * 3/1986 Herrin ..... 493/126
5,180,355 A * 1/1993 Inoue ..... 493/315

* cited by examiner

*Primary Examiner*—Stephen F. Gerrity
*Assistant Examiner*—Hemant M. Desai
(74) *Attorney, Agent, or Firm*—C. A. Rowley

(57) ABSTRACT

A method and apparatus for squaring knocked down slotted boxes employs an L-shaped support and forming platform onto which a partially opened box is applied so that the junction of the two legs of the L-shape is received within the box and a leading flap (and its fold line connection to the box) and a trailing flap (and its fold line connection to the box) each contact one of the legs to fold these flaps outward and tend to square the box. The trailing flap is moved from one leg onto the other which normally will be substantially flat and horizontal so that the leading and trailing flaps are folded perpendicular to the axis of the sleeve portion of the box while the side flaps positioned between the leading and trailing flaps remain in the plane of their respective box wall as the carton is moved into an operating station.

16 Claims, 3 Drawing Sheets

METHOD AND APPARATUS FOR SETTING UP A CARTON

FIELD OF INVENTION

The present invention relates to simplified a manual method and a facilitating apparatus for erecting and squaring a knocked down cartons

BACKGROUND OF THE INVENTION

One of the principal packaging cartons used in commerce is formed a slotted knocked down box blank, which normally consist of a sleeve with closure flaps in the form of bottom forming flaps foldably connected to one end of the sleeve and top closure flaps foldably connected to the other end of the sleeve. Such sleeves are usually 4 sided i.e. having 4 walls connected together at the intersection of a pair of adjacent walls by a manufacturer's joint, These knocked down box blanks are shipped flat (knocked down i.e. with opposite walls in face to face relationship) and are then erected, squared and formed into a box in the packager's plant by closing the flaps at one end of the sleeve (usually the bottom flaps) form.

Many different systems have been devised for mechanically opening squaring and forming these blanks into cartons with one end closed and the opposite end open to permit goods to be packed therein. These systems are generally either automatic i.e. done by machinery or manual. The so formed open ended cartons are then the filled with product (again either automatically by equipment or manually, the carton closed by closing systems that mechanically or manually fold the closure flaps (top flaps) into closed position substantially perpendicular to the axis of the sleeve to provide a filled and closed carton ready for shipping.

Mechanical devices include devices that move the blank through a series of stations that perform the desired operations in sequence along the way. In many of these systems some form of stop against which the blank is force is used to open and square the sleeve and plows are used to fold the closure flaps into closed position. The goods to be packaged may as above indicated be manually packed or automatically packed into the carton. In manual systems the sleeve supported on a table or the like on the ends of its closure flaps at one of the sleeve (flaps parallel to their respective side walls of the sleeve) is forces against a stop and squared and the uppermost set of flaps are folded to closed position and fixed in this closed position by taping, stapling gluing etc. in a closing station. The open-ended cartons so formed are then ready for filling and closing. This filling and closing in a manual system may be done in the same or a different closing station. Obviously the axial length of the carton supported on the ends of flaps at one end of the sleeve and with the other end closed is shorter than the axial length of the carton with both ends closed, thus the relative spacing between the support table and the closing equipment (taping, stapling gluing etc. equipment) must be change for closing the packed box necessitating an adjustable table height in a single station packing system so that the height may be change when sealing tone end of the empty sleeve and sealing the filled and closed box.

BRIEF DESCRIPTION OF THE PRESENT INVENTION

It is the object of the present invention to provide a simple method and apparatus to facilitate the setting up or squaring of a knocked down sleeve type folding (slotted) box and forming it into a box.

It is also an object of the present invention to provide a method and apparatus wherein the height of the supporting table or the like need not be changed when closing the sleeve to form the open ended box or when closing the filled box.

Broadly the present invention relates to a method of squaring a knocked down folding box formed by a sleeve with a first set of closure flaps connected by a first set of fold lines to one end of said sleeve and a second set of closure flaps connected by a second set of fold lines to a second end of said sleeve remote from said one end of said sleeve, said method comprising partially opening said box and moving said box toward an L-shaped support and forming platform formed by a pair of legs interconnected by a filleted corner so that said filleted corner is received within said sleeve and a leading flap of said first set flaps is moved against a first substantially horizontal leg of said pair of legs to fold said leading flap on its fold line of said first set of fold lines connecting it to a leading wall of said sleeve outward relative to said sleeve and a trailing flap of said first set of flaps is moved against a second of said pair of legs to fold said trailing flap on its fold line of said first set of fold lines connecting it to a trailing wall of said sleeve outward relative to said sleeve and moving said box along said legs to bring said trailing flap onto said first leg and position said leading and trailing flaps substantially perpendicular to a longitudinal axis of said sleeve to provide said box in a substantially squared condition.

Preferably said second set of flaps are folded on their respective fold lines of said second set of fold lines to close one end of said sleeve and said box is moved on said first leg into a closing station wherein said second set of flaps are secured in closed position substantially perpendicular to said longitudinal axis and closing said sleeve to form an open box.

Preferably said method further comprises inverting said open box and placing same on said one leg, folding said first set of flaps into a closed position and moving said box with said first set of flaps folded to closed position on said first leg into said closing station wherein said first set of flaps are secured in closed position substantially perpendicular to said longitudinal axis and closing said sleeve to form a closed box.

Preferably side flaps of said first set of flaps each is connected to its adjacent side wall of said sleeve interconnecting said leading and trailing walls of said sleeve by its side fold line of said first set of fold lines and said side flaps remain substantially parallel with said longitudinal axis when said box is squared and moved along said first leg into said closing station.

Preferably said leading wall is forced against a stop in said closing station to define the position of said leading wall in said closing station and to aid in ensuring said box is in said squared condition.

Broadly the present invention also relates to an apparatus for squaring a knocked down folding box comprises an L-shaped support and forming platform, said L-shaped support and forming platform being formed by a first substantially horizontal leg and a second leg extending downward from one end of said first leg, said legs being interconnected at their adjacent ends by a filleted corner, means for adjusting the width of said L-shaped support and forming platform to accommodate different sizes of said folding boxes, box operating station having means for operating on said box positioned spaced above said first leg and means for adjusting the spacing of said operating means relative to said first leg to accommodate different lengths of said boxes.

Preferably said box operating means comprises a box closure means and said operating station has a stop against which said box is moved to ensure said box is square in said closure station.

Preferably said operating station further includes ejector means for ejecting a closed box from said operating station after said box has been closed. Preferably said stop is part of said ejector means.

BRIEF DESCRIPTION OF THE SEVERAL VIEWS OF THE DRAWING(S)

Further features, objects and advantages will be evident from the following detailed description of the preferred embodiments of the present invention taken in conjunction with the accompanying drawings in which.

FIGS. 3A to 3F schematic illustration of the sequence of steps that are preferably used in practicing the present invention.

Figures 4, 5, 6:
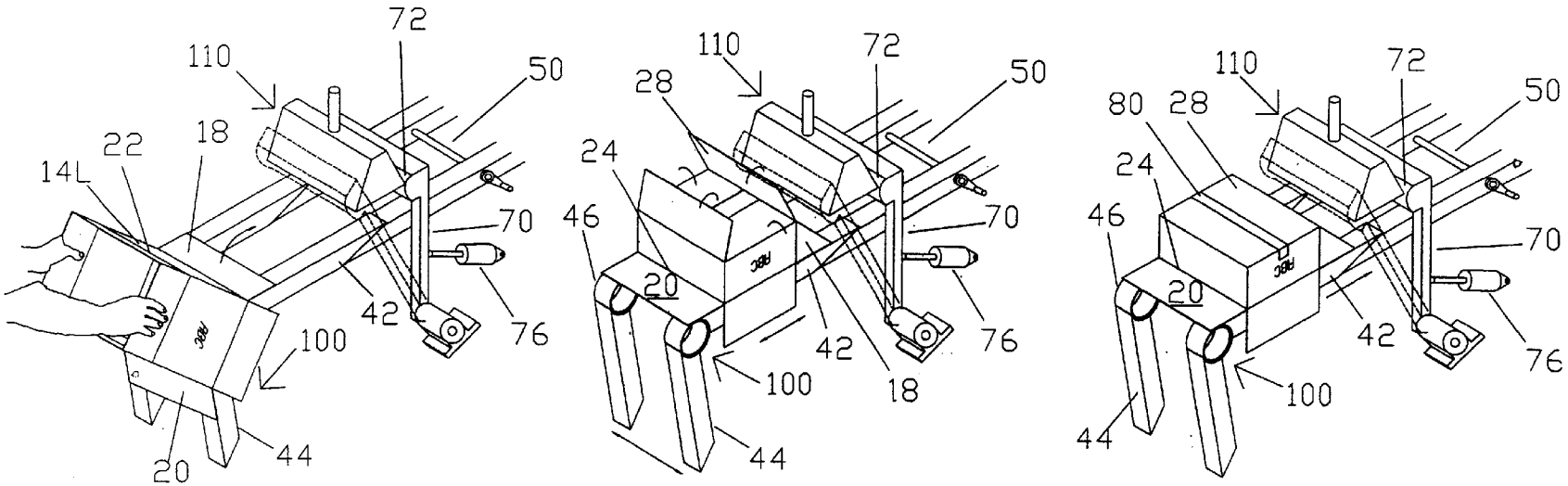

FIGS. 4, 5 and 6 schematically show in greater detail than in FIG. 3 the main steps in the sequence of forming of a box with one end closed and of the equipment employed.

DETAILED DESCRIPTION OF THE INVENTION

Figure 1:
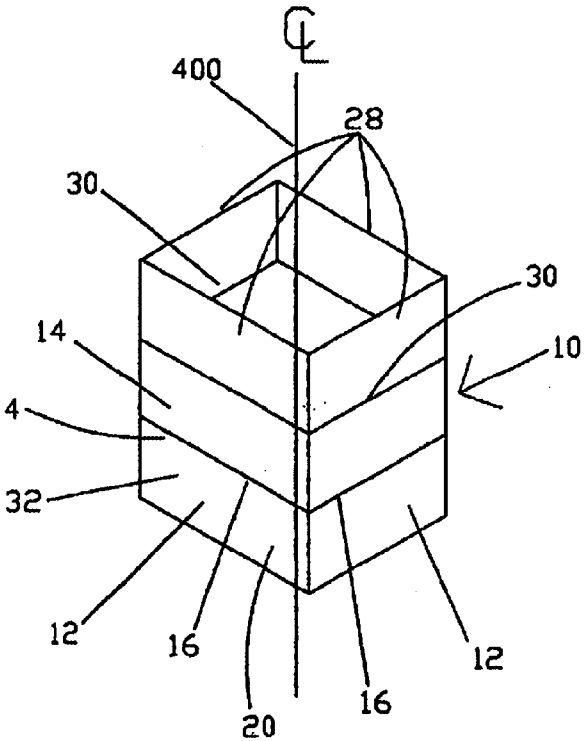
FIG. 1 is an isometric view of a typical slotted carton formed from a knocked down blank.

The method (sequence of steps) and the essential elements of the apparatus for carrying out the present invention are illustrated in FIG. 1.

Figures 3A, 3B, 3C, 3D, 3E, 3F:
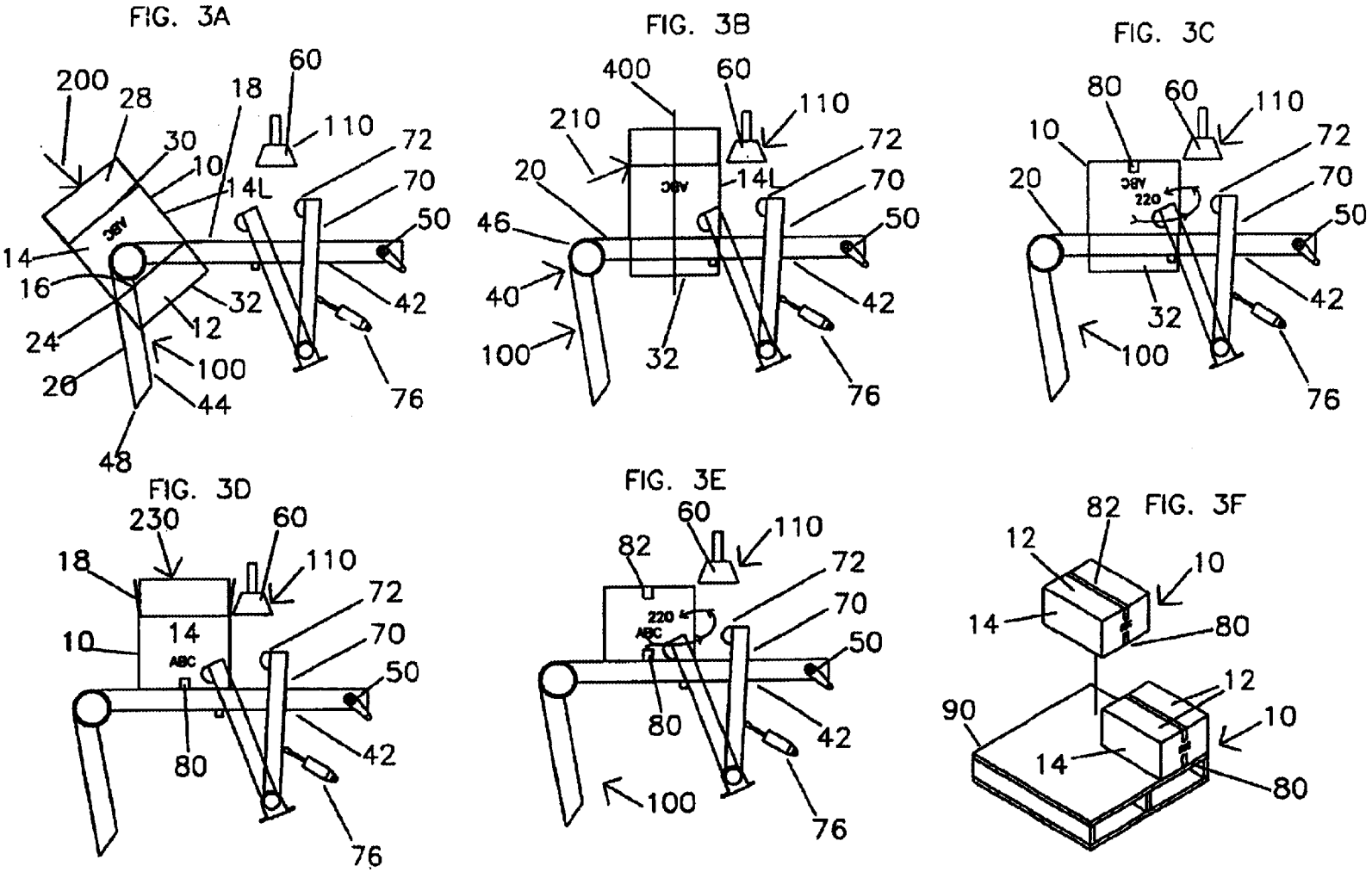

As shown in FIGS. 1 and 4 and the right hand image of FIG. 3A a box or carton 10 in the form of a slotted knocked down box 10 having a first set of closure flaps 12 (only 2 of 4 shown in FIG. 1) connected to the walls of the sleeve portion 14 of the box or box blank 10 by a first set of fold lines 16 The first set of flaps 12 includes a leading flap 18 (see FIGS. 3, 4, and 5) (leading in the direction of movement of the carton when closing the flaps 12) and a trailing flap 20 (see FIGS. 1, 3, 4, 5 and 6) (trailing in the direction of movement of the carton when closing the flaps 12) each connected to its adjacent wall of the sleeve 14 by one of the first set of fold lines 16 namely fold lines 22 and 24 respectively (see FIGS. 1, 3, 4 5 and 6). A second set of closure flaps 28 is connected to the opposite end of the sleeve 14 to the flaps 12 by a second set of fold lines 30. The flaps 12 and set of fold lines 16 are essentially the same as the flaps 28 and fold lines 30 and function in essentially the same manner to close the opposite ends of the sleeve 14 as will be described below. The flaps 12 may form the bottom of the filled carton and the flaps 28 the top or vice versa.

A device 100 for erecting and closing the cartons or boxes 10 is form by an L shaped support and forming platform 40 formed by a pair of legs 42 and 44 interconnected at their adjacent ends by a curved section that forms a fillet connection 46. The first leg 42 of the pair of legs preferably is substantially horizontal and the second leg 44 of the pair of legs extends downward there from so that the included angle θ there between is preferably less than 90° i.e. in the order of about 65 to about 80°. This selection of the preferred size of the included angle θ is based on the functioning of the device to open and square the carton, and it's preferred size is selected so that the free end 48 of the downwardly extending second leg 44 has lees tendency to interfere with the operator's legs.

The filleted connection 46 has a radius r to permit the trailing end of the blank 10 as it is being erected to move smoothly from the downwardly extending leg 44 over the curved section 46 and onto the leg 42. It has been found that this radius r for efficient operation should be at least about 2 inches (5 centimeters).

In the illustrated arrangement the legs 42 and 44 are each formed by a pair of parallel members; leg 42 by members 42A and 42B and leg 44; by members 44A and 44B interconnected by their respective curved sections 46A and 46B.

Figure 2:
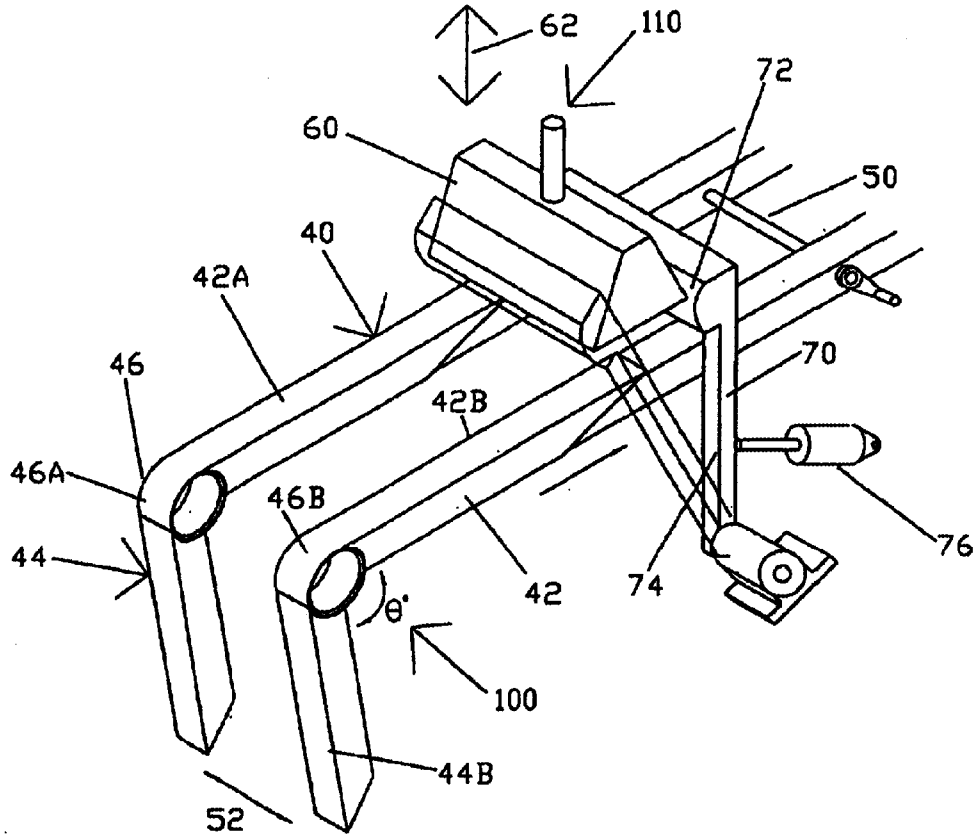
FIG. 2 is a schematic isometric illustration of a device constructed in accordance with the principles of the present invention for erecting (squaring and closing one end of cartons such as the one illustrated in FIG. 1.

In some cases it may be desirable to make the system adjustable for different sized boxes for use in plants where different sized boxes are to be processed on the same machine. To accommodate this the spacing between the members 42A, 44A and 46A and their respective opposed or cooperating members 42B, 44B and 46B may be made adjustable. For example a suitable adjustment mechanism which in the illustrated arrangement comprises a screw type adjuster 50 expands or reduces the spacing between the members 42A, 44A and 46A and their respective opposed or cooperating members 42B, 44B and 46B may be provided to adjust the width of the support 40 (i.e. legs 42 and 44) as illustrated by the arrow 52 (see FIG. 2) to accommodate different sized boxes 10.

Positioned adjacent to the end of the leg 42 remote from leg 44 is an operating station 110 that may incorporate any suitable operating mechanism such as a labeler or closing mechanism or the like. In the illustrated arrangement a flap sealer 60 which may take the form of a stapler, taper or gluer or any other suitable flap-sealing device has been shown. If multiple size boxes are to be processed the size of the operating station 110 e.g. the flap sealer 60 may have to be change either by physically changing the sealer or by adjusting the effective size of the sealer depending on the type of sealer being used and the height of this device 60 relative to the leg 42 may have to be adjusted as indicated by the arrow 62 to accommodate sleeves 14 of different axial lengths.

The station 110 preferably will also include a squaring ejector 70 which in the illustrated arrangement is formed by a bar 72 supported by arms 74 and biased to ejecting position (as indicated in dash lines in FIG. 2) by a biasing means such as pneumatic means 76 but other means may be used. The bar 72 is oriented to be parallel to the surface of the leg 42 and perpendicular to the intended direction of movement of the carton 10 into the station 110 and is spaced above the table or leg 42 by a distance such that the leading flap 18 as will be described below may pass under it and the bar contact directly the leading wall of the carton or box 10 and aid in squaring the box 10.

The stroke of the bar 72 is set so that when in fully retracted position it insures that the carton 10 being operated upon in the operating station 110 e.g. the sealer 60 are relatively position as desired with the leading wall of the sleeve 14 pressed against the bar 72. As will be described below, when the operation in the operating station 110 is completed the carton 10 is released and the sealer 60 retracted if required and the bar 72 is moved to eject the carton from the sealing or closing station 110 by the biasing means 76.

In the illustrated system conventional plowing guides not shown may be provided to contact sidewalls of the sleeve 14 and aid in squaring the box 10.

It will be apparent that for more versatile machines the position of the bar 72 for positioning different sized boxes 10 will be made adjustable.

As shown in FIG. 3A the partially opened box blank 10 is manually (or mechanically) moved down as indicated by the arrow 200 to a position wherein the curved portion 46 connecting the legs 42 and 44 is received within the sleeve portion 14 of the box 10. In this position the leading flap 18 and its connecting fold line, lead fold line 22, are moved against the support surface of the leg 42 to fold the flap 18 outward relative to the sleeve 14 and similarly the tailing flap 20 and its connecting fold line, trailing fold line 24, are moved against the surface of the leg 44 to fold the flap 20 outward relative to the sleeve 14 as shown in the FIG. 3A.

It is preferred but not necessary that the leading and trail flaps 18 and 20 be major (longer than the minor flaps as measured parallel to their fold line connection to the sleeve 14) flaps of the box 10 as illustrated so that the side flaps 32 are formed by minor flaps (shorter than the major flaps as measured parallel to their fold line connection to the sleeve 14) only one shown (see FIGS. 1 and 3). Obviously in a square cross section box 10 all flaps have essentially the same length.

The opened and reasonably squared carton 10 is moved as indicated by the arrow 210 (see FIG. 3B) with the flaps 18 and 20 and their respective fold lines 22 and 24 held in contact with the surfaces of the legs 42 and 44 (FIG. 3A) so that the trailing fold line 24 and flap 20 are moved into position on the supporting surface of the leg 42 and the flaps 18 and 20 extend substantially perpendicular to the tubular axis 400 (see FIGS. 1 and FIG. 3B) of the sleeve 14 and parallel to the surface of leg 42. If an ejector 70 is provided the leading wall 14L (see FIGS. 3A and 3B and FIG. 4) into contact with the bar 72 which finalizes the squaring of the box 10 (see FIGS. 4 and 5 and FIG. 3B). In this position the other flaps 28 (which will normally form the bottom of the packed box 10) are folded into closed position in the illustrated arrangement manually (see FIG. 5).

The box 10 with the flaps 28 at the end not in contact with the leg 42 folded into closed position is moved manually into the operating station 110 forcing the bar 72 rearward against the biasing means 70 and when properly positioned in this station 110 the sealer 60 or the like is activated in this case to secure the flaps 28 in closed position. In the illustrated arrangement an adhesive type tape 80 is applied to tape the flaps 28 in closed position and then the sealer 60 retracts and the carton 10 with one end closed is ejected from the station 110 by movement of the bar 72 to its normal or rest position as shown in Stages 1 and 2 see that arrow 220 (FIG. 3C and FIG. 6).

Next the carton 10 is inverted to position the closed end (flaps 28) on the leg 42 and either the leading or trailing wall of the sleeve in the preceding operations leading (in the illustration the trailing flap 20 has become the leading flap in FIG. 3D and preferably in contact with the bar 72 and the carton 10 may be packed with goods as indicated by the arrows 230 (see FIG. 3D).

After the carton 10 has been filled the set of flaps 12 (flaps 18, 20 32 etc.) are folded on their respective fold line of the set of fold lines 16 to close the open end of the box 10 (in the same manner as the flaps 28 were folded to closed position (see FIG. 5) and the box moved as shown in FIG. 3E which is essentially the same as FIG. 3C described above into the operating station 110 and the sealer 60 or the like activated to perform its function e.g. to secure the flaps 12 in closed position (as illustrated), in the illustrated arrangement by applying a second tape 82 similar to the tape 80 described above to provide a filled and closed carton ready for shipment.

As indicated in FIG. 3F generally a plurality of such filed and closed cartons or boxes 10 are stacked on a suitable pallet 90 or the like to form a pallet load and such loads are then shipped as required.

Having described the invention, modifications will be evident to those skilled in the art without departing from the scope of the invention as defined in the appended claims.

I claim:

1. A method of squaring a knocked down folding box formed by a sleeve with a first set of closure flaps connected by a first set of fold lines to one end of said sleeve and a second set of closure flaps connected by a second set of fold lines to a second end of said sleeve remote from said one end of said sleeve, said method comprising partially opening said box and moving said box toward an L-shaped support and forming platform formed by a pair of legs interconnected by a filleted corner so that said filleted corner is received within said sleeve and a leading flap of said first set of flaps is moved against a first substantially horizontal leg of said pair of legs to fold said leading flap on its fold line of said first set of fold lines connecting it to a leading wall of said sleeve outward relative to said sleeve and a tailing flap of said first set of flaps is moved against a second leg of said pair of legs to fold said trailing flap on its fold line of said first set of fold lines connecting it to a trailing wall of said sleeve outward relative to said sleeve and moving said box along said legs to bring said trailing flap onto said first leg and position said leading and trailing flaps substantially perpendicular to a longitudinal axis of said sleeve to provide said box in a substantially squared condition.

2. A method as defined in claim 1 wherein said second set of flaps are then folded on their respective fold lines of said second set of fold lines to close one end of said sleeve and said box is moved on said first leg into a closing station wherein said second set of flaps are secured in closed position substantially perpendicular to said longitudinal axis and closing said sleeve to form an open box.

3. A method as defined in claim 2 further comprising inverting said open box and placing same on said first leg, folding said first set of flaps into closed position and moving said box with said first set of flaps folded to closed position on said first leg into said closing station without adjusting the relative positions of said closure station and said first leg and securing said first set of flaps in closed position substantially perpendicular to said longitudinal axis and closing said sleeve to form a closed box.

4. A method as defined in claim 3 wherein side flaps of said first set of flaps each connected with its adjacent side wall of said sleeve interconnecting said leading and trailing walls of said sleeve by its side fold line of said first set of fold lines and said side flaps remain substantially parallel with said longitudinal axis when said box is squared and moved along said first leg into said closing station.

5. A method as defined in claim 4 wherein said leading wall is forced against a stop in said closing station to define the position of said leading wall in said closing station and to aid in ensuring said box is in said squared condition.

6. A method as defined in claim 3 wherein said leading wall is forced against a stop in said closing station to define the position of said leading wall in said closing station and to aid in ensuring said box is in said squared condition.

7. A method as defined in claim 2 wherein side flaps of said first set of flaps each connected with its adjacent side wall of said sleeve interconnecting said leading and trailing walls of said sleeve by its side fold line of said first set of fold lines and said side flaps remain substantially parallel with said longitudinal axis when said box is squared and moved along said first leg into said closing station.

8. A method as defined in claim 5 wherein said leading wall is forced against a stop in said closing station to define the position of said leading wall in said closing station and to aid in ensuring said box is in said squared condition.

9. A method as defined in claim 2 wherein said leading wall is forced against a stop in said closing station to define the position of said leading wall in said closing station and to aid in ensuring said box is in said squared condition.

10. A method as defined in claim 1 wherein side flaps of said first set of flaps each connected to its adjacent side wall of said sleeve interconnecting said leading and trailing walls of said sleeve by its side fold line of said first set of fold lines and said side flaps remain substantially parallel with said longitudinal axis when said box is squared and moved along said first leg into said closing station.

11. A method as defined in claim 1 wherein said leading wall is forced against a stop in said closing station to define the position of said leading wall in said closing station and to aid in ensuring said box is in said squared condition.

12. An apparatus for squaring a knocked down folding box comprises a L-shaped support and forming platform, said L-shaped support and forming platform being formed by a pair of L-shaped supports, each said L-shaped support being formed by a first substantially horizontal leg and a second leg extending downward from one end of said first leg, said legs being interconnected at their adjacent ends by a filleted corner, means for adjusting the width of said L-shaped support and forming platform to accommodate different sizes of said folding boxes, box operating station having means for operating on said box positioned spaced above said first leg and means for adjusting the spacing of said operating means relative to said first leg to accommodate different lengths of said boxes.

13. An apparatus as defined in claim 12 wherein said box operating means comprises a box closure means and said operating station has a stop against which said box is moved to ensure said box is square in said box closure means.

14. An apparatus as defined in claim 13 wherein said operating station further includes ejector means for ejecting a box from said operating station.

15. An apparatus as defined in claim 14 wherein said stop is part of said ejector means.

16. An apparatus as defined in claim 12 wherein said operating station further includes ejector means for ejecting a box from said operating station.

* * * * *